US009695811B2

(12) United States Patent
Kang et al.

(10) Patent No.: US 9,695,811 B2
(45) Date of Patent: Jul. 4, 2017

(54) LINEAR COMPRESSOR

(71) Applicant: LG ELECTRONICS INC., Seoul (KR)

(72) Inventors: Kyoungseok Kang, Seoul (KR); Wonhyun Jung, Seoul (KR); Chulgi Roh, Seoul (KR); Kiwook Song, Seoul (KR); Jookon Kim, Seoul (KR); Sangsub Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 114 days.

(21) Appl. No.: 14/317,120

(22) Filed: Jun. 27, 2014

(65) Prior Publication Data

US 2015/0004027 A1 Jan. 1, 2015

(30) Foreign Application Priority Data

Jun. 28, 2013 (KR) ..... 10-2013-0075512
Jun. 28, 2013 (KR) ..... 10-2013-0075514
Oct. 4, 2013 (KR) ..... 10-2013-0118580

(51) Int. Cl.
*F04B 35/04* (2006.01)
*F04B 39/00* (2006.01)
(Continued)

(52) U.S. Cl.
CPC ..... *F04B 35/045* (2013.01); *F04B 39/0061* (2013.01); *F04B 39/0284* (2013.01); *F04B 39/122* (2013.01); *F04B 39/127* (2013.01)

(58) Field of Classification Search
CPC .. F04B 35/045; F04B 39/122; F04B 39/0016; F04B 39/0061; F04B 39/0284;
(Continued)

(56) References Cited

U.S. PATENT DOCUMENTS 3,007,625 A 11/1961 Heinrich
3,143,281 A 8/1964 Heinrich
(Continued)

FOREIGN PATENT DOCUMENTS

CN 1480648 3/2004
CN 1508427 6/2004
(Continued)

OTHER PUBLICATIONS

European Search Report dated Sep. 25, 2015.
(Continued)

*Primary Examiner* — Dominick L Plakkoottam
(74) *Attorney, Agent, or Firm* — KED & Associates, LLP

(57) ABSTRACT

A linear compressor is provided. The linear compressor may include a shell having a refrigerant inlet, a cylinder arranged in the shell, a piston that reciprocates in the cylinder, a motor assembly that provides a drive force to the piston and having a permanent magnet, and a frame arranged on or at a side of the motor assembly. The cylinder may include a first outer circumference with which an inner stator of the motor assembly may be combined, and a second outer circumference that extends from the first outer circumference and forcibly press-fit into the frame.

21 Claims, 8 Drawing Sheets

(51) Int. Cl.
*F04B 39/12* (2006.01)
*F04B 39/02* (2006.01)

(58) Field of Classification Search
CPC ..... F04B 39/127; F04D 15/00; F04D 27/00; F04D 27/02
USPC ..... 417/415, 417, 545
See application file for complete search history.

(56) References Cited

U.S. PATENT DOCUMENTS

| | | | | |
|---|---|---|---|---|
| 3,813,192 | A | 5/1974 | Adams | |
| 4,027,211 | A | 5/1977 | Omura | |
| 4,827,163 | A | 5/1989 | Bhate et al. | |
| 4,924,675 | A | 5/1990 | Higham | |
| 4,932,313 | A | 6/1990 | Gutknecht | |
| 4,937,481 | A | 6/1990 | Vitale | |
| 5,559,378 | A | 9/1996 | Oudet et al. | |
| 5,693,991 | A | 12/1997 | Hiterer et al. | |
| 5,704,771 | A | 1/1998 | Fujisawa | |
| 6,097,125 | A | 8/2000 | Park et al. | |
| 6,273,688 | B1 | 8/2001 | Kawahara | |
| 6,328,544 | B1 | 12/2001 | Kawahara et al. | |
| 6,379,125 | B1 | 4/2002 | Tojo | |
| 6,398,523 | B1 | 6/2002 | Hur et al. | |
| 6,413,057 | B1 | 7/2002 | Hong | |
| 6,435,842 | B2 | 8/2002 | Song | |
| 6,561,144 | B1 | 5/2003 | Muraji | |
| 6,575,716 | B1 | 6/2003 | Morita et al. | |
| 6,666,662 | B2 | 12/2003 | Oh | |
| 6,755,627 | B2 | 6/2004 | Chang | |
| 6,793,470 | B2 | 9/2004 | Song | |
| 6,863,506 | B2 | 3/2005 | Park | |
| 6,875,000 | B2 | 4/2005 | Bae | |
| 6,894,407 | B2 | 5/2005 | Jung | |
| 6,994,530 | B2 | 2/2006 | Fujisawa et al. | |
| 7,288,862 | B2 | 10/2007 | Song | |
| 7,331,772 | B2 | 2/2008 | Jung | |
| 7,404,701 | B2 | 7/2008 | Kwon | |
| 7,478,996 | B2 | 1/2009 | Kang | |
| 7,537,438 | B2 | 5/2009 | Song | |
| 7,614,856 | B2 | 11/2009 | Inagaki et al. | |
| 7,617,594 | B2 | 11/2009 | Hyeon | |
| 7,626,289 | B2 | 12/2009 | Her | |
| 7,649,285 | B2 | 1/2010 | Ueda | |
| 7,748,963 | B2 | 7/2010 | Lee | |
| 7,748,967 | B2 | 7/2010 | Park | |
| 7,901,192 | B2 | 3/2011 | Cho | |
| 7,922,463 | B2 | 4/2011 | Lee | |
| 7,934,910 | B2 | 5/2011 | Park | |
| 8,109,199 | B2 | 2/2012 | Kim | |
| 8,109,740 | B2 | 2/2012 | Kang | |
| 8,303,273 | B2 | 11/2012 | Kang | |
| 8,556,599 | B2 | 10/2013 | Lee | |
| 2003/0147759 | A1 | 8/2003 | Chang | |
| 2004/0047750 | A1 | 3/2004 | Kim et al. | |
| 2004/0061583 | A1 | 4/2004 | Yumita | |
| 2004/0109777 | A1 | 6/2004 | Hur | |
| 2004/0145248 | A1 | 7/2004 | Jung et al. | |
| 2004/0247457 | A1 | 12/2004 | Kim et al. | |
| 2005/0098031 | A1 | 5/2005 | Yoon et al. | |
| 2005/0140216 | A1 | 6/2005 | Lee | |
| 2005/0142007 | A1 | 6/2005 | Lee | |
| 2005/0214140 | A1 | 9/2005 | Lee | |
| 2006/0024181 | A1 | 2/2006 | Kim | |
| 2006/0060196 | A1 | 3/2006 | Kim | |
| 2006/0145797 | A1 | 7/2006 | Muramatsu et al. | |
| 2006/0171825 | A1 | 8/2006 | Choi | |
| 2006/0280630 | A1 | 12/2006 | Lee et al. | |
| 2007/0009370 | A1 | 1/2007 | Kim et al. | |
| 2007/0110600 | A1* | 5/2007 | Park | F04B 35/045 417/417 |
| 2007/0134108 | A1 | 6/2007 | Her | |
| 2007/0166176 | A1 | 7/2007 | Kang et al. | |
| 2008/0000348 | A1 | 1/2008 | Schubert et al. | |
| 2009/0101003 | A1 | 4/2009 | Kim et al. | |
| 2010/0021323 | A1 | 1/2010 | Schubert | |
| 2010/0260627 | A1 | 10/2010 | Kang et al. | |
| 2010/0260628 | A1 | 10/2010 | Kim | |
| 2010/0260629 | A1* | 10/2010 | Kang | F04B 35/045 417/417 |
| 2010/0290936 | A1 | 11/2010 | Kang et al. | |
| 2010/0316513 | A1 | 12/2010 | Lee et al. | |
| 2011/0194957 | A1 | 8/2011 | Kang | |
| 2013/0004343 | A1* | 1/2013 | Cho | F04B 35/045 417/321 |
| 2013/0058815 | A1 | 3/2013 | Kim | |
| 2013/0195613 | A1* | 8/2013 | Kim | F04B 35/045 415/1 |

FOREIGN PATENT DOCUMENTS

| | | | |
|---|---|---|---|
| CN | 1862016 | | 11/2006 |
| CN | 101133247 | | 2/2008 |
| CN | 101835983 | | 9/2010 |
| CN | 203770066 | | 8/2014 |
| CN | 203835658 | | 9/2014 |
| CN | 203867810 | | 10/2014 |
| CN | 203906211 | | 10/2014 |
| CN | 203906214 | | 10/2014 |
| CN | 203978749 | | 12/2014 |
| EP | 2 312 157 | | 4/2011 |
| JP | 05-240156 | A | 9/1993 |
| JP | 2000-002181 | | 1/2000 |
| JP | 2001-158995 | A | 6/2001 |
| JP | 2002-122072 | | 4/2002 |
| JP | 2002-138954 | A | 5/2002 |
| JP | 2006-280156 | A | 10/2006 |
| JP | 2007-291991 | | 11/2007 |
| JP | 2010-200522 | A | 9/2010 |
| JP | 2013-015092 | A | 1/2013 |
| KR | 10-0792460 | | 1/2008 |
| KR | 10-2010-0010421 | | 2/2010 |
| KR | 10-2010-0112474 | | 10/2010 |
| KR | 10-2013-0118464 | A | 10/2013 |
| KR | 10-2013-0118580 | A | 10/2013 |
| KR | 10-2013-0075512 | A | 10/2014 |
| KR | 10-2013-0075514 | A | 10/2014 |
| WO | WO 0277455 | A1 | 10/2002 |
| WO | WO 2007/046608 | | 4/2007 |
| WO | WO 2012/088571 | | 7/2012 |

OTHER PUBLICATIONS

Korean Office Action dated Oct. 13, 2014 issued in Application No. 10-2013-0075512.
Korean Office Action dated Oct. 13, 2014 issued in Application No. 10-2013-0075514.
Chinese Patent Certificate dated Aug. 13, 2014 issued in Application No. 201420160887.6 (patented as CN 203770066 U).
Chinese Patent Certificate dated Sep. 17, 2014 issued in Application No. 201420187800.4 (patented as CN 203835658 U).
European Search Report dated Nov. 14, 2014 issued in Application No. 14 16 8916.6.
Chinese Office Action dated Dec. 14, 2015.
Chinese Office Action dated Dec. 25, 2015.
Chinese Office Action dated Dec. 28, 2015.
(3)Chinese Office Actions dated Dec. 30, 2015.
European Search Report dated Aug. 10, 2015.
Korean Office Action dated Jul. 24, 2015. (0075512).
European Search Report dated Sep. 7, 2015.
European Search Report dated Sep. 21, 2015.
European Search Report dated Sep. 17, 2015.
European Search Report dated Oct. 2, 2015.
European Search Report dated Oct. 14, 2015.
Chinese Office Action date Dec. 28, 2015.
United States Office Action dated Sep. 8, 2016 issued in U.S. Appl. No. 14/317,336.
United States Office Action dated Sep. 30, 2016 issued in U.S. Appl. No. 14/316,908.

(56) References Cited

OTHER PUBLICATIONS

United States Office Action dated Oct. 11, 2016 issued in U.S. Appl. No. 14/280,825.
United States Final Office Action dated Oct. 17, 2016 issued in U.S. Appl. No. 14/317,218.
U.S. Office Action issued in U.S. Appl. No. 14/317,172 dated May 19, 2016.
U.S. Office Action issued in U.S. Appl. No. 14/317,217 dated Jun. 15, 2016.
U.S. Office Action issued in U.S. Appl. No. 14/317,218 dated May 20, 2016.
United States Office Action dated Jan. 26, 2017 issued in U.S. Appl. No. 14/317,041.
Chinese Patent No. 104251196 issued Oct. 5, 2016.
United States Office Action dated Jan. 26, 2016 issued in U.S. Appl. No. 14/317,041.
U.S. Appl. No. 14/280,825, filed May 19, 2014, Thomas R. Cash.
U.S. Appl. No. 14/316,908, filed Jun. 27, 2014, Patrick Hamo.
U.S. Appl. No. 14/317,172, filed Jun. 27, 2014, Christopher S. Bobish.
U.S. Appl. No. 14/317,041, filed Jun. 27, 2014, Christopher S. Bobish.
U.S. Appl. No. 14/317,217, filed Jun. 27, 2014, Christopher S. Bobish.
U.S. Appl. No. 14/317,218, filed Jun. 27, 2014, Peter John Bertheaud.
U.S. Appl. No. 14/317,336, filed Jun. 27, 2014, Peter John Bertheaud.
U.S. Office Action dated Dec. 1, 2016 issued in U.S. Appl. No. 14/317,172.
U.S. Office Action dated Dec. 16, 2016 issued in U.S. Appl. No. 14/317,217.
European Search Report dated Oct. 12, 2016 issued in Application No. 16172236.8.

* cited by examiner

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2013-0075512, filed in Korea on Jun. 28, 2013, No. 10-2013-0075514, filed in Korea on Jun. 28, 2013, and No. 10-2013-0118580, filed in Korea on Oct. 4, 2013, which are hereby incorporated by reference in their entirety.

BACKGROUND

1. Field

A linear compressor is disclosed herein.

2. Background

In general, compressors may be mechanisms that receive power from power generation devices, such as electric motors or turbines, to compress air, refrigerants, or other working gases, thereby increasing a pressure of the working gas. Compressors are being widely used in home appliances or industrial machineries, such as refrigerators and air-conditioners.

Compressors may be largely classified into reciprocating compressors, in which a compression space, into and from which a working gas, such as a refrigerant, is suctioned and discharged, is defined between a piston and a cylinder to compress a refrigerant while the piston is linearly reciprocated within the cylinder; rotary compressors, in which a compression space, into and from which a working gas, such as a refrigerant, is suctioned and discharged, is defined between a roller, which is eccentrically rotated, and a cylinder to compress the refrigerant while the roller is eccentrically rotated along an inner wall of the cylinder; and scroll compressors, in which a compression space, into and from which a working gas, such as a refrigerant, is suctioned and discharged, is defined between an orbiting scroll and a fixed scroll to compress the refrigerant while the orbiting scroll is rotated along the fixed scroll. In recent years, among the reciprocating compressors, linear compressors having a simple structure in which a piston is directly connected to a drive motor, which is linearly reciprocated, to improve compression efficiency without mechanical loss due to switching in moving are being actively developed. Generally, such a linear compressor is configured to suction and compress a refrigerant while a piston is linearly reciprocated within a cylinder by a linear motor in a sealed shell, thereby discharging the compressed refrigerant.

The linear motor has a structure in which a permanent magnet is disposed between an inner stator and an outer stator. The permanent magnet may be linearly reciprocated by a mutual electromagnetic force between the permanent magnet and the inner (or outer) stator. Also, as the permanent magnet is operated in a state in which the permanent magnet is connected to the piston, the refrigerant may be suctioned and compressed while the piston is linearly reciprocated within the cylinder and then be discharged.

A linear compressor according to the related art is disclosed in Korean Patent Publication No. 10-2010-0112474. Referring to FIGS. 1 and 2 of the Korean Patent Application, in the case of a typical linear compressor, a frame and a cylinder are integrally formed in a closed container. More specifically, the cylinder is manufactured through magnetic casting, and then aluminum, a non-magnetic material, is insert-molded onto the outer circumferential surface of the cylinder to manufacture the frame.

The frame integrally formed with the cylinder may be coupled to a peripheral component, for example, a discharge valve assembly or a motor cover. In this case, a force (coupling force) applied when the frame is coupled to the discharge valve assembly or the motor cover may be applied to the cylinder.

When the coupling force is applied to the cylinder 3, the cylinder is deformed. In addition, when the deformation of the cylinder is significant, interference may occur due to the friction between the cylinder and the piston reciprocating in the cylinder.

As such, as interference occurs between the cylinder and the piston, there is a limitation in that interference occurs among a permanent magnet connected to the piston, an inner stator, and an outer stator, and thus, parts may be damaged. In addition, there are limitations in that due to the deformation of the cylinder, cracks may occur in the piston and the cylinder, and a compression gas may be externally leaked through the cracks.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference accompanying drawings. However, the scope of the present disclosure is not limited to the embodiments herein, and thus, a person skilled in the art, who understood the scope of the present disclosure, would easily suggest other embodiments within the same scope thereof.

Figure 1:
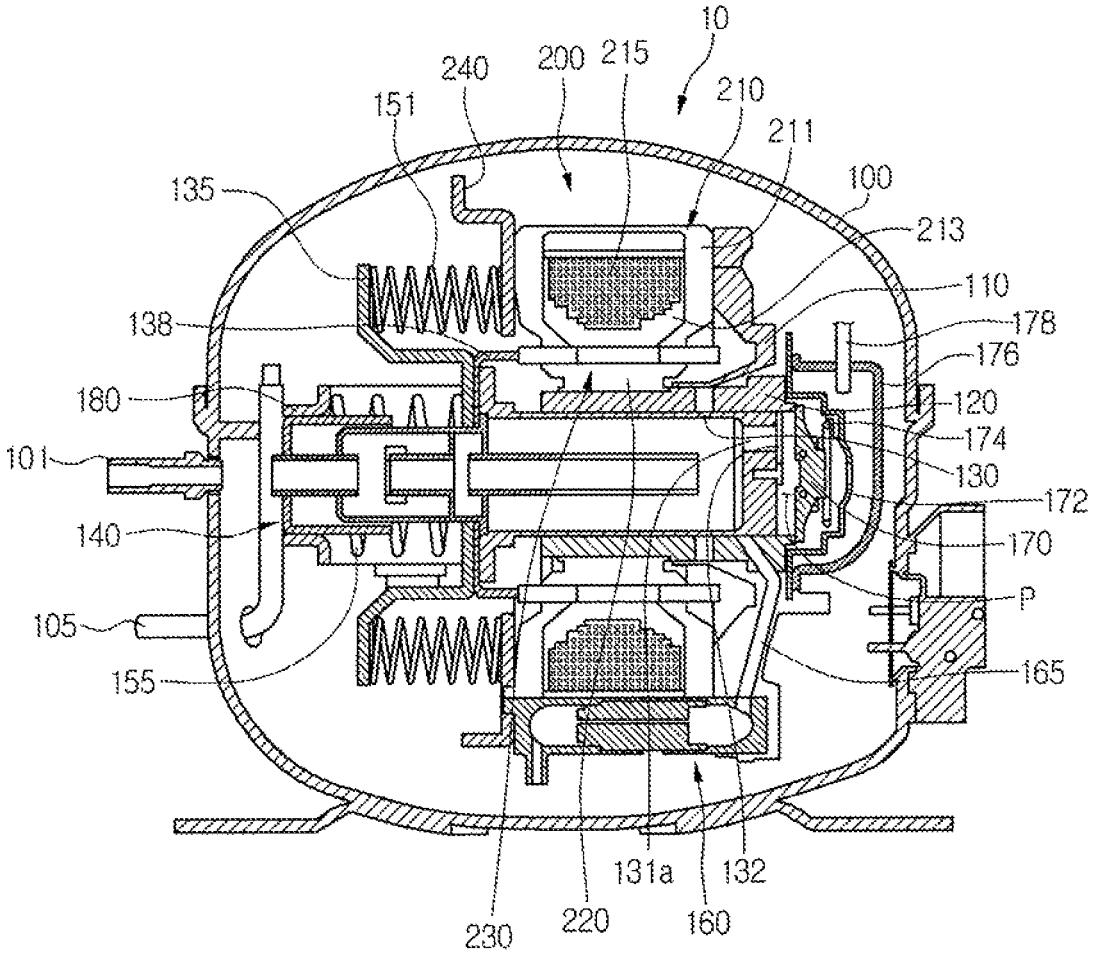
FIG. 1 is a cross-sectional view of a linear compressor according to an embodiment.

FIG. 1 is a cross-sectional view of a linear compressor according to an embodiment. Referring to FIG. 1, the linear compressor 10 may include a cylinder 120 disposed in a shell 100, a piston 130 that linearly reciprocates inside the cylinder 120, and a motor assembly 200, which may be a linear motor, that exerts a drive force on the piston 130. The shell 100 may include an upper shell and a lower hell.

The cylinder 120 may be made of a nonmagnetic material, such as an aluminum-based material, for example, aluminum or aluminum alloy. As the cylinder 120 may be made of the aluminum-based material, magnetic flux generated in the motor assembly 200 may be delivered to the cylinder 120, thereby preventing the magnetic flux from being leaked to the outside of the cylinder 120. The cylinder 120 may be formed by extruded rod processing, for example.

The piston 130 may be made of an aluminum material, for example, aluminum or aluminum alloy, a non-magnetic material. As the piston 130 may be made of the aluminum material, it may be possible to prevent magnetic flux generated from the motor assembly 200 from being leaked to the outside of the piston 130. In addition, the piston 130 may be formed by using a forging method, for example.

In addition, a component ratio of materials of the cylinder 120 and the piston 130, that is, types and composition ratios thereof may be the same. The piston 130 and the cylinder 120 may be made of the same material, for example, aluminum, and thus, may have a same thermal expansion coefficient. During operation of the linear compressor 10, a high-temperature environment (about 100℃) may be created in the shell 100. At this time, the piston 130 and the cylinder 120 may have the same thermal expansion coefficient, and thus, may have a same amount of thermal deformation. As a result, as the piston 130 and the cylinder 120 may be thermally deformed by different amounts or in different directions, it may be possible to prevent interference with the cylinder 120 during movement of the piston 130.

The shell 100 may include an inlet 101, through which a refrigerant may flow into the shell 100, and a discharge 105, through which the refrigerant compressed in the cylinder 120 may be discharged from the shell 100. The refrigerant suctioned through the inlet 101 may flow into the piston 130 via a suction muffler 140. While the refrigerant passes through the suction muffler 140, noise may be reduced.

A compression space P to compress the refrigerant by the piston 130 may be defined in the cylinder 120. A suction hole 131*a*, through which the refrigerant may be introduced into the compression space P, may be defined in the piston 130, and a suction valve 132 to selectively open the suction hole 131*a* may be disposed at a side of the suction hole 131*a*.

A discharge valve assembly 170, 172, and 174 to discharge the refrigerant compressed in the compression space P may be disposed at a side of the compression space P. That is, the compression space P may be formed between an end of the piston 130 and the discharge valve assembly 170, 172, and 174.

The discharge valve assembly 170, 172, and 174 may include a discharge cover 172, in which a discharge space for the refrigerant may be defined; a discharge valve 170, which may be opened and introduce the refrigerant into the discharge space when the pressure of the compression space P is not less than a discharge pressure; and a valve spring 174, which may be disposed between the discharge valve 170 and the discharge cover 172 to exert an elastic force in an axial direction. The term "axial direction" used herein may refer to a direction in which the piston linearly reciprocates, that is, a horizontal direction in FIG. 1.

The suction valve 132 may be disposed at a first side of the compression space P, and the discharge valve 170 may be disposed at a second side of the compression space P, that is, at an opposite side of the suction valve 132. While the piston 130 linearly reciprocates inside the cylinder 120, the suction valve 132 may be opened to allow the refrigerant to be introduced into the compression space P when the pressure of the compression space P is lower than the discharge pressure and not greater than a suction pressure. In contrast, when the pressure of the compression space P is not less than the suction pressure, the refrigerant in the compression space P may be compressed in a state in which the suction valve 132 is closed.

If the pressure in the compression space P is the discharge pressure or greater, the valve spring 174 may be deformed to open the discharge valve 170, and the refrigerant may be discharged from the compression space P into the discharge space of the discharge cover 172. The refrigerant in the discharge space may flow into a loop pipe 178 via a discharge muffler 176. The discharge muffler 176 may reduce flow noise of the compressed refrigerant, and the loop pipe 178 may guide the compressed refrigerant to the outlet 105. The loop pipe 178 may be coupled to the discharge muffler 176 and may curvedly extend to be coupled to the outlet 105.

The linear compressor 10 may further include a frame 110. The frame 110 may fix the cylinder 120 within the shell 100. For example, the cylinder 120 may be press-fit, or press-fit coupled into the frame 110.

The press-fit or press-fit coupling may refer to a technique that when a first object is inserted into a second object, at least one of the first object or the second object is deformed by a certain force for combination if a size or diameter of the first object is larger than a size or diameter of the second object.

While the cylinder 120 and the frame 110 are combined, the frame 110 may be coupled to the discharge muffler 176 or the discharge cover 172 by a coupling member, for example. In addition, the frame 110 may be coupled to the stator cover 240. For example, the coupling member may be a bolt.

The frame 110 may be made of an aluminum-based material, for example, aluminum or aluminum alloy, a non-magnetic material. As the frame 110 may be made of the aluminum-based material, it is possible to prevent magnetic flux generated from the motor assembly 200 from becoming delivered to the frame 110 and leaked to the outside of the frame 110.

The motor assembly 200 may include an outer stator 210, which may be fixed to the frame 110 and disposed so as to surround the cylinder 120, an inner stator 220 disposed apart from an inside of the outer stator 210, and a permanent magnet 230 disposed in a space between the outer stator 210 and the inner stator 220. The permanent magnet 230 may linearly reciprocate by a mutual electromagnetic force between the outer stator 210 and the inner stator 220. The permanent magnet 230 may include a single magnet having one pole, or multiple magnets having three poles. In addition, the permanent magnet 230 may be made of a ferrite material, which is relatively inexpensive.

The permanent magnet 230 may be coupled to the piston 130 by a connection member 138, for example. The connection member 138 may extend to the permanent magnet from an end of the piston 130. As the permanent magnet 230 linearly moves, the piston 130 may linearly reciprocate in an axial direction along with the permanent magnet 230.

The outer stator 210 may include a bobbin 213, a coil 215, and a stator core 211. The coil 215 may be wound in a circumferential direction of the bobbin 213. The coil 215 may have a polygonal section, for example, a hexagonal section. The stator core 211 may be provided such that a plurality of laminations is stacked in a circumferential direction, and may be disposed to surround the bobbin 213 and the coil 215.

If a current is applied to the motor assembly 200, the current may flow through the coil 215, flux may be formed around the coil 215 by the current flowing through the coil 215, and the flux may flow forming a closed loop along the outer stator 210 and the inner stator 220. Flux flowing along the outer stator 210 and the inner stator 220 and flux in the permanent magnet 230 may interact, so a force to move the permanent magnet 230 may be generated.

The state cover 240 may be disposed at a side of the outer stator 210. A first end of the outer stator 210 may be supported by the frame 110, and a second end thereof may be supported by the stator cover 240. The frame 110 and the stator cover 240 may be coupled by a coupling member (not shown), for example.

The inner stator 220 may be fixed to an outer circumference of the cylinder 120. The inner stator 220 may be configured such that a plurality of laminations is stacked at an outer side of the cylinder 120 in a circumferential direction.

The linear compressor 10 may further include a supporter 135 that supports the piston 130, and a back cover 180 that extends toward the inlet 101 from the piston 130. The back cover 180 may be disposed to cover at least a portion of the suction muffler 140.

The linear compressor 10 may include a plurality of springs 151 and 155, a natural frequency each of which may be adjusted so as to allow the piston 130 to perform a resonant motion, the springs being elastic members. The plurality of springs 151 and 155 may include a plurality of first springs 151 supported between the supporter 135 and the stator cover 240, and a plurality of second springs 155 supported between the supporter 135 and the back cover 180. An elastic modulus of the plurality of first springs 151 and the plurality of second springs 155 may be equally formed.

The plurality of first springs 151 may be provided at both sides of the cylinder 120 or the piston 130, and the plurality of second springs 155 may be provided at a front of the cylinder 120 or piston 130. The term "front" used herein may refer to a direction oriented toward the inlet 101 from the piston 130. The term 'rear' may refer to a direction oriented toward the discharge valve assembly 170, 172, and 174 from the inlet 101. These terms may be equally used in the following description.

A predetermined amount of oil may be stored on an inner bottom surface of the shell 100. An oil supply device 160 to pump oil may be provided in a lower portion of the shell 100. The oil supply device 160 may be operated by vibration generated according to linear reciprocating motion of the piston 130 to thereby pump the oil upward.

The linear compressor 10 may further include an oil supply pipe 165 that guides the flow of the oil from the oil supply device 160. The oil supply pipe 165 may extend from the oil supply device 160 to a space between the cylinder 120 and the piston 130. The oil pumped from the oil supply device 160 may be supplied to the space between the cylinder 120 and the piston 130 via the oil supply pipe 165, and perform cooling and lubricating operations.

Figure 2:
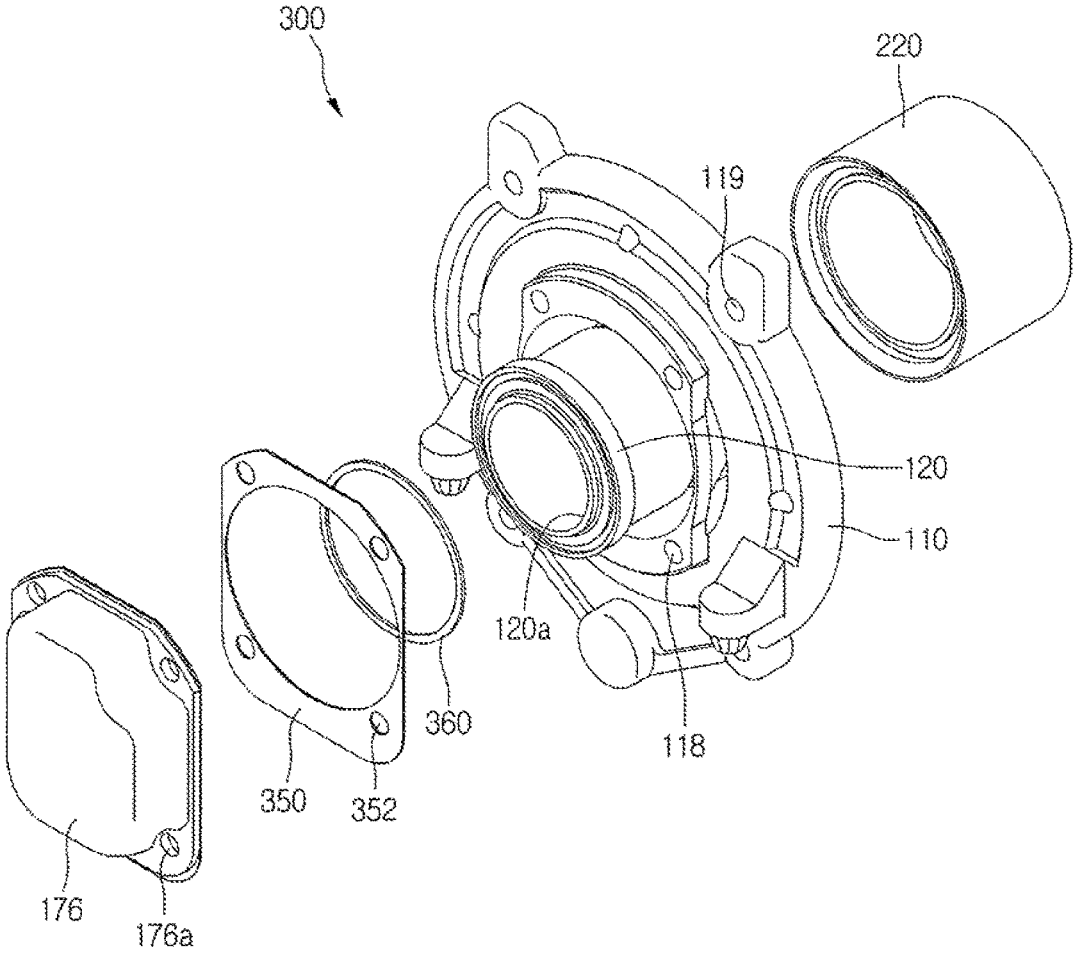
FIG. 2 is an exploded perspective view of a frame assembly of a linear compressor according to an embodiment.
Figure 3:
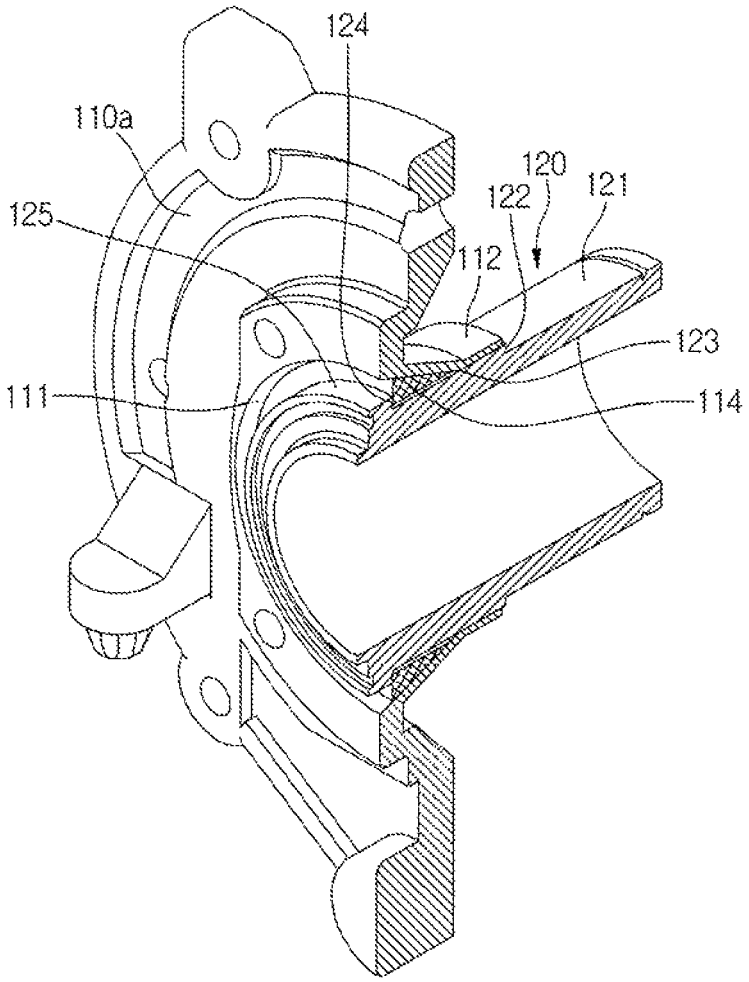
FIG. 3 is a cross-sectional perspective view of a combination of a frame and a cylinder according to an embodiment.
Figure 4:
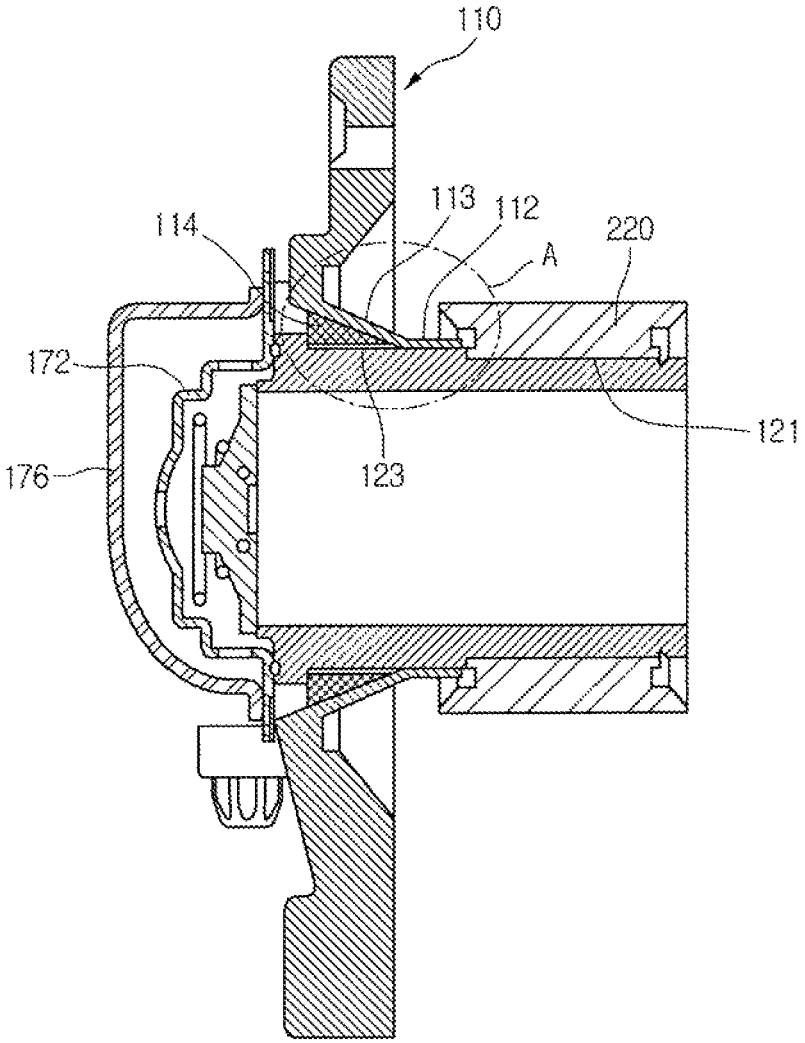
FIG. 4 is a cross-sectional view of a combination of a frame assembly and a discharge muffler according to an embodiment.

FIG. 2 is an exploded perspective view a frame assembly of a linear compressor according to an embodiment. FIG. 3 is a cross-sectional perspective view of a combination of a frame and a cylinder according to an embodiment. FIG. 4 is a cross-sectional view of a combination of a frame assembly and a discharge muffler according to an embodiment.

Referring to FIGS. 2 to 4, a frame assembly according to an embodiment may include frame 110 including a frame body 110*a* that forms an insertion part or portion 111, cylinder 120 inserted into the insertion portion 111, and inner stator 220 combined with an outer circumferential surface of the cylinder 120.

The frame body 110*a* may have an approximate circular or plate shape. In addition, the insertion portion 111 may be formed in a manner that at least a portion of the frame body 110*a* is removed, and the cylinder 120 may be inserted in one direction through the insertion portion 111. The frame may include press fit part or portion 112 arranged on a side of the insertion portion 111 and combined with the cylinder 120.

An opening 120*a* combined with discharge valve 170 may be formed in the cylinder 120. The opening 120*a* may refer to an opening in an end of the cylinder 120. If the discharge valve 170 opens, the refrigerant compressed in the compression space P may flow into discharge cover 172 via the opening 120*a*.

Discharge muffler 176 may be provided on one side of the frame 110. In addition, bracket 350 may be provided between the frame 110 and the discharge muffler 176.

A first coupling hole 176*a* may be formed in the discharge muffler 176, and a third coupling hole 118 may be formed in the frame 110. In addition, a second coupling hole 352 may be formed in the bracket 350. A coupling member may pass through the first to third coupling holes 176*a*, 352, and 118 and combine the frame 110, the bracket 350, and the discharge muffler 176. The bracket 350 may facilitate close contact between the frame 110 and the discharge muffler 176.

A seal 360 may be provided around the opening 120*a*. While the frame 110 and the discharge muffler 176 are combined, the seal 360 may be arranged where the opening 120*a* of the cylinder 120 and the discharge muffler 176 are combined. While refrigerant flows from the cylinder 120 to the discharged cover 172, the seal 360 may prevent the refrigerant from leaking.

A fourth coupling hole 119 may be formed in the frame 110. The fourth coupling hole 119 may be combined with the stator cover 240 by a coupling member, for example. The outer stator 210 may be held on a side of the frame 110 on which the fourth coupling hole 119 may be formed.

The cylinder 120 may include a plurality of outer circumferential parts or portions 121, 123, and 125 that form the outer circumferential surface of the cylinder 120 and have different external diameters. The outer circumferential portions 121, 123, and 125 may include a first outer circumferential part or portion 121 combined with the inner stator 220. The inner stator 220 may be press-fit coupled onto an outer circumferential surface of the first outer circumferential portion 121. The inner stator 220 may have a hollow cylindrical shape to surround the first outer circumferential portion 121.

A second outer circumferential part or portion 123 may extend to or along a side of the first outer circumferential portion 121. The second outer circumferential portion 123 may extend from the first outer circumferential portion 121 toward the opening 120*a*.

An external diameter of the second outer circumferential portion 123 may be larger than a diameter of the first outer circumferential portion 121. A stepped part or step 122 that externally extends in a radial direction may be formed on or at an interface between the first outer circumferential portion 121 and the second outer circumferential portion 123. Due to the step 122, the external diameter of the second outer circumferential part 123 may be larger than the diameter of the first outer circumferential portion 121.

The second outer circumferential portion 123 may provide a surface in contact with the frame 110. The term "contact" may refer to contact for the press-fitting into the frame 110.

A third outer circumferential part or portion 125 may extend to a side of the second outer circumferential portion 123. The third outer circumferential portion 125 may extend from the second outer circumferential portion 123 toward the opening 120*a*.

An external diameter of the third outer circumferential portion 125 may be formed to be larger than the diameter of the second outer circumferential portion 123. A protrusion 124 that externally extends in a radial direction may be formed on an interface between the second outer circumferential portion 123 and the third outer circumferential portion 125. Due to the protrusion 124, the external diameter of the third outer circumferential portion 125 may be larger than the diameter of the second outer circumferential portion 123.

The protrusion 124 may provide a surface that is in contact with the frame 110. The term "contact" may be a contact for being hooked on the frame 110.

The frame 110 may include the press-fit portion 112, into which the cylinder 120 may be press-fit while the cylinder is inserted into the frame 110. The press-fit portion 112 may have an approximate cylindrical shape and may be combined to surround the outer circumferential surface of the second outer circumferential portion 123.

That is, the internal diameter of the press-fit portion 112 may be smaller than the external diameter of the second outer circumferential portion 123. When the second outer circumferential portion 123 is press-fit into the press-fit portion 112, at least one of the second outer circumferential portion 123 or the press-fit portion 112 may be deformed. That is, deformation may be made in a manner that the internal diameter of the second outer circumferential portion 123 may be reduced or the external diameter of the press-fit portion 112 may be expanded.

A slope 113 may be formed on or at a side of the press-fit portion 112 connected to the frame body 110*a*. The slope 113 may be formed so that an internal diameter decreases as the slope 113 extends away from the frame body 110*a*. The slope 113 may have a cylindrical shape having a sloping outer circumferential surface to surround the cylinder 120.

The slope 113 may be combined with a portion of the frame body 110*a* on which the insertion portion 111 is formed. As the slope 113 extends upwardly, it may not be in contact with the cylinder 120. That is, the frame 110 may be combined with the cylinder 120 on or at a portion of the press-fit portion 112 other than the slope 113, and it may be arranged on the slope 113 to be spaced outwardly from the cylinder 120. As such, as an area or region where the frame 110 is in contact with the cylinder 120 may not be wide, a magnitude of a force delivered to the cylinder 120 among forces applied to the frame 110 may not be great.

Thus, it may be possible to reduce deformation of the cylinder 120. In particular, when considering that the frame 110 and the cylinder 120 are made of a soft aluminum based material, a deformation level of the cylinder 120 may significantly depend on force, and thus, it may be very useful to decrease a force delivered to the cylinder 120.

A hook part or hook 114 may be provided under the slope 113. The hook 114 may be hooked on the protrusion 124. The cylinder 120 may be inserted in one direction (right direction in FIG. 4) through the insertion portion 111, and the first outer circumferential portion 121 may be inserted first. In addition, the cylinder 120 may be inserted until there is interference between the hook 114 and the protrusion 124.

Figure 5:
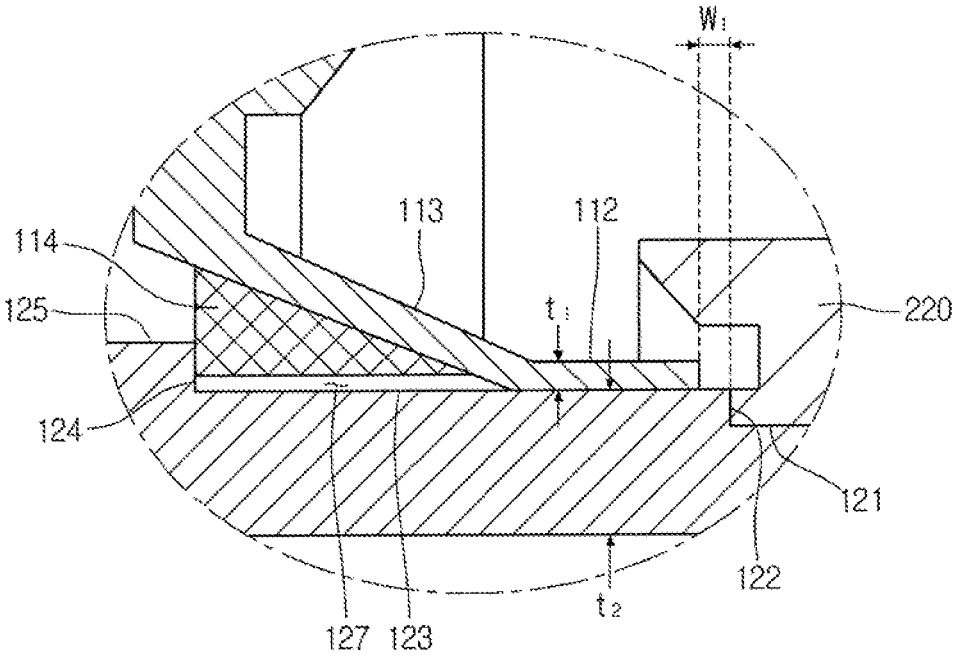
FIG. 5 is an enlarged view of circled portion "A" of FIG. 4.
Figure 6:
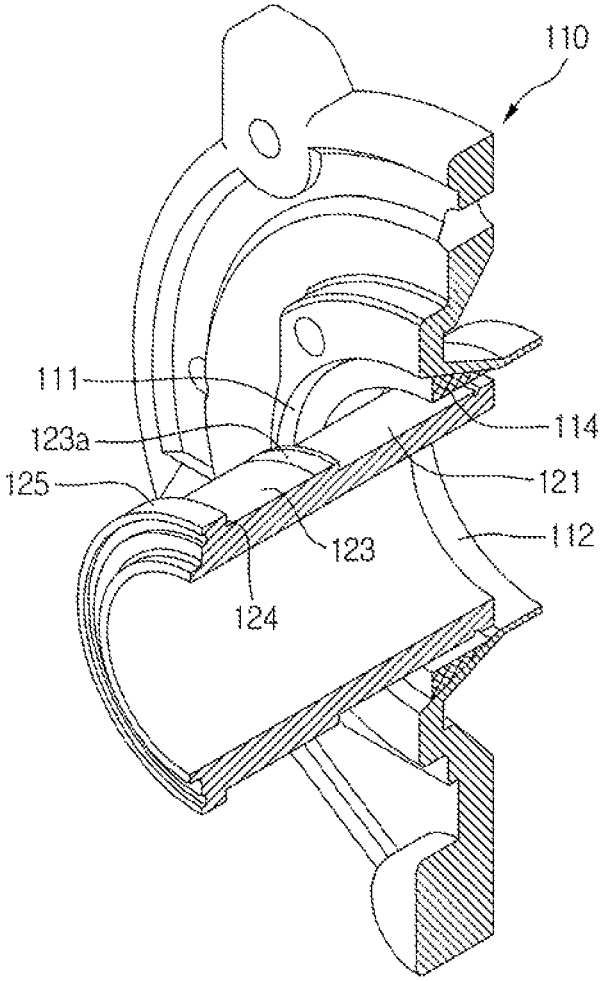
FIGS. 6 and 7 are cross-sectional perspective views showing, before combination, a frame and a cylinder according to an embodiment.
Figure 7:
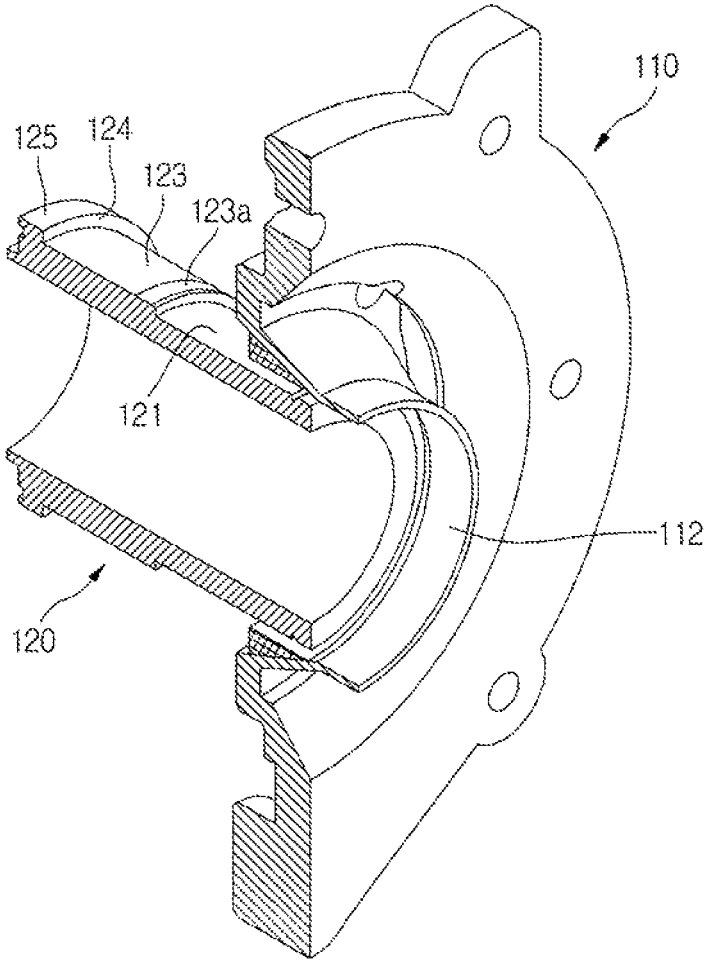

FIG. 5 is an enlarged view of circled portion "A" of FIG. 4. FIGS. 6 and 7 are cross-sectional perspective views showing, before combination, a frame and a cylinder according to an embodiment.

Referring to FIGS. 5 to 7, a portion of the press-fit portion 112 of the frame 110 according to an embodiment other than the slope 113 may be press-fit coupled to at least a portion of the second outer circumferential portion 123 of the cylinder 120. The second outer circumferential portion 123 may include a press-fit corresponding part or portion 123*a* combined with the press-fit portion 112. The press-fit corresponding portion 123*a* may form the outer circumferential surface of at least a portion of the second outer circumferential portion 123.

A thickness of the press-fit portion 112, that is, a height t1 may be smaller than a thickness t2 of the press-fit corresponding portion 123*a*. For example, the thickness t2 may have a value approximately five times to eight times the thickness t1.

$5:1 < t2:t1 < 8:1$

Due to a thickness difference between the press-fit portion 112 and the press-fit corresponding portion 123*a*, while the second outer circumferential portion 123 may be press-fit into the press-fit portion 112, there may be a deformation difference between the press-fit portion 112 and the second outer circumferential portion 123. That is, deformation of the cylinder 120 having a thick thickness may be less than deformation of the press-fit portion 112 having a relatively thin thickness.

In particular, as the frame 110 and the cylinder 120 may each be made of an aluminum-based material, when a certain force is applied to the frame 110 or the cylinder 120, the deformation level of the frame 110 or the cylinder 120 may significantly depend on the force.

For example, by a ratio of the thickness t1 and the thickness t2, deformation of the press-fit portion 112 may have a value that is approximately 250 times to 350 times the deformation of the second outer circumferential portion 123. As the deformation is in inverse proportion to an elastic modulus of an aluminum-based material, an elastic modulus of the press-fit portion 112 may have a value that is 1/350 to 1/250 the elastic modulus of the second outer circumferential portion 123.

The inner stator 220 may be press-fit into the first outer circumferential portion 121 of the cylinder 120. In addition, the step 122 may be in contact with an external surface of the inner stator 220. In contrast, the external surface of the inner stator 220 may be spaced from the frame 110.

More specifically, a virtual first line formed by extending the step 122 in a radial direction is WI spaced from a virtual second line formed by extending the end of the press-fit portion 112 in a radial direction. Thus, the inner stator 220 may be in contact with the step 122, while not in contact with the press-fit portion 112.

With such a configuration, while the inner stator 220 is press-fit into the cylinder 120, the inner stator 220 does not apply a force (pressing force) to the frame 110. Thus, it is possible to prevent a force from the inner stator 220 from becoming delivered to the second outer circumferential portion 123 through the press-fit portion 112. As a result, it is possible to prevent deformation of the cylinder 120.

On the other hand, the hook 114 arranged on the frame 110 may be hooked on the protrusion 124 of the cylinder 120. In this case, a contact surface on which hooking is performed may vertically extend in a radial direction with respect to the outer circumferential surface of the second outer circumferential portion 123.

In addition, a space 127 may be formed between the hook 114 and the second outer circumferential portion 123. That is, the space 127 may be a space between the hook 114 and the second outer circumferential portion 123. That is, the hook 114 may be arranged to be spaced from the second outer circumferential portion 123. In summary, the hook 114 may be in contact with the cylinder 120 through the protrusion 124, while not in contact with the second outer circumferential portion 123.

As such, even if hooking is performed through the hook 114 between the frame 110 and the cylinder 120, it is possible to decrease a magnitude of a force delivered between the frame 110 and the cylinder 120 by preventing unnecessary contact except for the hook 114.

A location where the press-fit portion 112 is in contact with the press-fit corresponding portion 123*a* may be referred to as "a first contact", and a location where the hook 114 is in contact with the protrusion 124 may be referred to as "a second contact" The first contact may extend forward and backward from a portion of the outer circumferential surface of the cylinder 120, and the second contact may extend in a radial direction from a portion of the outer circumferential surface of the cylinder 120. That is, one surface formed by the first contact may be substantially perpendicular to another surface formed by the second contact.

Figure 8:
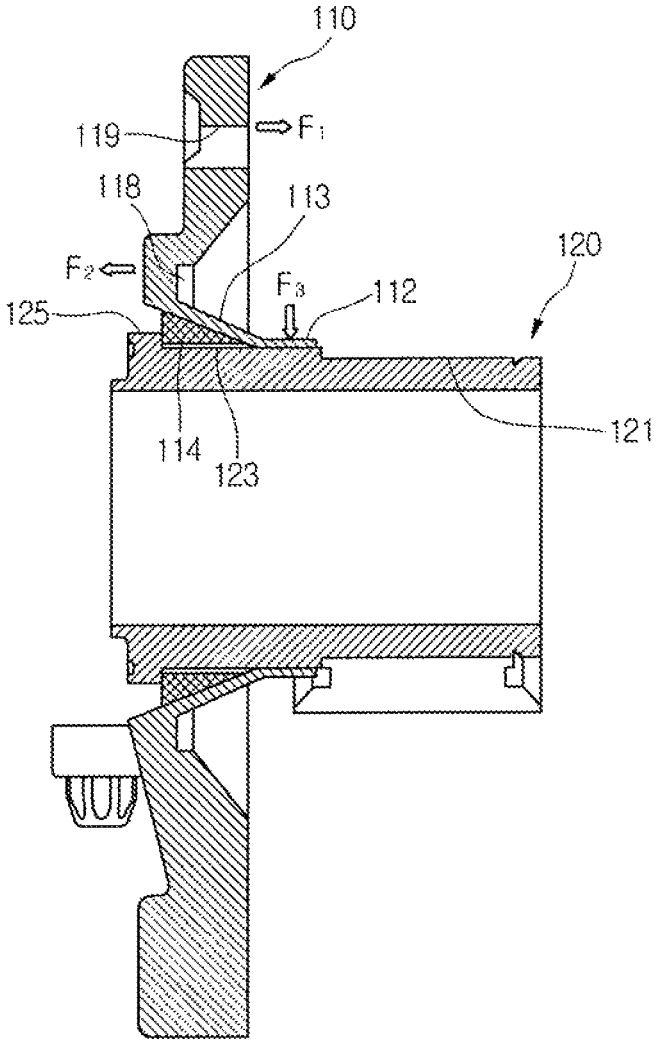
FIG. 8 is a cross-sectional view showing how forces are applied on a frame assembly according to an embodiment.

FIG. 8 is a cross-sectional view showing how forces are applied on a frame assembly according to an embodiment. Referring to FIGS. 6 to 8, the cylinder 120 may be inserted into the insertion portion 111 of the frame 110. The cylinder 120 may be inserted in a manner such that the first outer circumferential portion 121 may pass through the insertion portion 111, and then the second outer circumferential portion 123 may pass through the insertion portion 111.

As the first outer circumferential portion 121 may be smaller than the internal diameter of the press-fit portion 112, it may be inserted without interference. On the other hand, as the second outer circumferential portion 123 may be larger than the internal diameter of the press-fit portion 112, there may be interference with the press-fit portion 112. In this state, if a certain force is applied, the second outer circumferential portion 123 may be press-fit into the press-fit portion 112.

While being press-fit, the second outer circumferential portion 123 or the press-fit portion 112 may be deformed. However, as described in FIG. 5, as the thickness and elastic modulus of the second outer circumferential portion 123 may be larger than those of the press-fit portion 112, the deformation of the second outer circumferential portion 123 may be relatively small.

The cylinder 120 may be inserted until the protrusion 124 is hooked on the hook 114. The insertion may be completed when the protrusion 124 interferes with the hook 114.

While the frame 110 and the cylinder 120 are combined, the frame 110 may be coupled to the discharge muffler 176 or the stator cover 240 by a coupling member, for example. That is, a coupling member may be combined with the third coupling hole 118 to combine the discharge muffler 176 with the frame 110, and another coupling member may be combined with the fourth coupling hole 119 to combine the stator cover 240 with the frame 110.

As such, when the frame 110 is coupled to internal components of a linear compressor, a coupling force may be applied to the frame 110. For example, a coupling force generated through the fourth coupling hole 119 may be F1 and a coupling force generated through the third coupling hole 118 may be F2.

In addition, at least a portion F3 of the coupling forces F1 and F2 applied to the frame 110 may be delivered to the cylinder 120 through the press-fit portion 112. That is, a coupling force applied to the frame 110 may be delivered to the cylinder 120 through a region where the frame 110 is press-fit coupled to the cylinder 120.

As described above, as the frame 110 may be detachably combined with the cylinder 120 and a press-fit coupled region or area is narrow, the magnitude of a force delivered to the cylinder 120 may not be large. As a result, it is possible to decrease deformation of the cylinder 120 due to the frame 110.

According to embodiments, as the cylinder and the frame may be detachably combined and an area where the cylinder is combined with the frame may be narrow, the magnitude of a force delivered to the cylinder among coupling forces generated when the frame is coupled to the internal component of the compressor may be small. As a result, as the magnitude of a force generated when the frame presses the cylinder is small, embodiments may have the effect that deformation of the cylinder may be small, and thus, it may be possible to prevent interference between the piston and the cylinder.

In particular, as the thickness of the press-fit part or portion of the frame press-fit into the outer circumferential surface of the cylinder may be thinner than that of the outer circumferential surface of the cylinder, and the elastic modulus of the press-fit part may be smaller than that of the outer circumferential surface of the cylinder, there is an advantage in that it may be possible to decrease deformation of the outer circumferential surface of the cylinder.

Moreover, as the inner stator press-fit into the outer circumferential surface of the cylinder may be arranged spaced from the press-fit portion of the frame, the coupling force of the frame may not be delivered to the inner stator, and thus, it may be possible to prevent the coupling of the frame from becoming delivered to the cylinder through the inner stator. Also, as the frame of the cylinder may be made of a nonmagnetic material, such as an aluminum-based material, and it may be possible to prevent flux generated from the motor assembly from becoming leaked outside of the cylinder, there is an advantage in that it is possible to improve efficiency of the compressor. Additionally, as the permanent magnet arranged in the motor assembly may be made of a cheap ferrite material, there is an advantage in that it may be possible to decrease manufacturing costs of the compressor.

Embodiments disclosed herein provide a linear compressor that may prevent deformation of a cylinder.

Embodiments disclosed herein provide a linear compressor that may include a shell having a refrigerant inlet; a cylinder arranged in the shell; a piston that reciprocates in the cylinder; a motor assembly that provides a drive force to the piston and having a permanent magnet; and a frame arranged on one side of the motor assembly. The cylinder may include a first outer circumferential part or first outer circumference with which an inner stator of the motor assembly may be combined, and a second outer circumferential part or second outer circumference that extends from the first outer circumferential part and forcibly press-fit into the frame.

The frame may include a frame body having an insertion part or portion into which the cylinder may be inserted, and a press-fit part that extends from the frame body and into which the second outer circumferential part of the cylinder may be forcibly press-fit. A slope may be formed on a side of the press-fit part, which may be connected to the frame body. The slope may be formed such that an internal diameter becomes small as the slope extends away from the frame body.

The frame may further include a hook part or hook on an inner circumferential surface of the slope. The hook part may be hooked on a protrusion of the cylinder. A space may be formed between the hook part of the frame and the second outer circumferential part.

The cylinder may further include a stepped part or step. The stepped part may be formed on an interface between the first outer circumferential part and the second outer circumferential part and support the inner stator. An external diameter of the second outer circumferential part may be formed to be larger than an external diameter of the first outer circumferential part.

An end of the press-fit part of the cylinder may be spaced from the inner stator.

The cylinder may further include a third outer circumferential part or third outer circumference that extends from the second outer circumferential part. The protrusion may be formed on an interface between the second outer circumferential part and the third outer circumferential part. An external diameter of the third outer circumferential part may be formed to be larger than an external diameter of the second outer circumferential part.

The second outer circumferential part may further include a press-fit corresponding part or portion combined with the press-fit part. A thickness of the press-fit corresponding part may be formed to be thicker than a thickness of the press-fit part. The thickness of the press-fit corresponding part may be formed to be approximately five times to eight times the thickness of the press-fit part.

The motor assembly may further include an outer stator and a stator cover that supports the outer stator. Further, the frame rr may be coupled to the stator cover.

The linear compressor may further include a discharge value selectively opened to enable refrigerant compressed in the cylinder to be externally discharged, and a discharge muffler that surrounds the discharge value. The frame may be coupled to the discharge muffler. The frame and the cylinder may be made of aluminum or an aluminum alloy.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art

What is claimed is:

1. A linear compressor, comprising:

a shell having an inlet;

a cylinder provided within the shell;

a piston that reciprocates in the cylinder;

a motor assembly that provides a drive force to the piston and having a permanent magnet; and a frame arranged on a first side of the motor assembly; wherein the cylinder includes:

a first outer circumference with which an inner stator of the motor assembly is combined;

a second outer circumference that extends from the first outer circumference and which is forcibly press-fit into the frame;

a third outer circumference that extends from the second outer circumference;

a first step formed at an interface between the first outer circumference and the second outer circumference that supports an outer circumferential surface of the inner stator; and a second step formed at an interface between the second outer circumference and the third outer circumference, wherein the second step includes a protrusion, wherein the frame includes:

a frame body haying an insertion portion into which the cylinder is inserted;

a press-fit portion into which the second outer circumference of the cylinder is forcibly press-fit;

a slope formed between the frame body and the press-fit portion; and a hook that protrudes from an inner circumferential surface of the slope in a radial direction, wherein the hook is hooked on the protrusion, and wherein a space is formed between an inner circumferential surface of the hook and the second outer circumference.

2. The linear compressor according to claim 1, wherein an inner diameter of the slope decreases as the slope, extends from the frame body to the press-fit portion.

3. The linear compressor according to claim 1, wherein an external diameter of the second outer circumference is larger than an external diameter of the first outer circumference.

4. The linear compressor according to claim 1, wherein an end of the press-fit portion of the frame is spaced from the inner stator.

5. The linear compressor according to claim 1, wherein an external diameter of the third outer circumference is larger than a diameter of the second outer circumference.

6. The linear compressor according to claim 1, wherein the second outer circumference includes a press-fit corresponding portion combined with the press-fit portion, and wherein a thickness of the press-fit corresponding portion is greater than a thickness of the press-fit portion.

7. The linear compressor according to claim 6, wherein the thickness of the press-fit portion corresponding portion is five times to eight times the thickness of the press-fit portion.

8. The linear compressor according to claim 1, wherein the motor assembly further includes an outer stator and a stator cover that supports the outer stator, and wherein the frame is coupled to the stator cover.

9. The linear compressor according to claim 1, further including:

a discharge valve selectively opened to enable a refrigerant compressed in the cylinder to be discharged outside; and a discharge muffler that surrounds the discharge valve, wherein the frame is coupled to the discharge muffler.

10. The linear compressor according to claim 1, wherein the frame and the cylinder are made of aluminum or an aluminum alloy.

11. A linear compressor, comprising:

a shell having an inlet;

a cylinder provided within the shell;

a piston that reciprocates axially in the cylinder;

a motor assembly that provides a drive force to the piston and haying a permanent magnet; and a frame arranged on a first side of the motor assembly and including a press-fit portion into which the cylinder is forcibly press-fit, wherein the cylinder includes:

a first outer circumference with which an inner stator of the motor assembly is combined; and a second outer circumference that extends from the first outer circumference and which is forcibly press-fit into the press-fit portion of the frame, wherein an external diameter of the second outer circumference is larger than an external diameter of the first outer circumference; and a first step formed at an interface between the first outer circumference and the second outer circumference, wherein the first step extends in a radial direction, wherein the inner stator is hooked to the first step, and wherein the inner stator is spaced apart from an end portion of the press-fit portion of the frame such that the inner stator does not contact with the press-fit portion.

12. The linear compressor according to claim 11, wherein the frame further includes:

a frame body having an insertion portion into which the cylinder is inserted.

13. The linear compressor according to claim 12, wherein a slope is formed between the frame body and the press-fit portion, and wherein an inner diameter of the slope decreases as the slope extends from the frame body to the press-fit portion.

14. The linear compressor according to claim 13, wherein the frame further includes a hook at an inner circumferential surface of the slope, the hook being configured to be hooked on a protrusion of the cylinder.

15. The linear compressor according to claim 14, wherein a space is formed between the hook and the second outer circumference.

16. The linear compressor according to claim 11, wherein the cylinder further includes a third outer circumference that extends from the second outer circumference.

17. The linear compressor according to claim 16, wherein a second step is formed at an interface between the second outer circumference and the third outer circumference.

18. The linear compressor according to claim 16, wherein an external diameter of the third outer circumference is larger than the external diameter of the second outer circumference.

19. The linear compressor according to claim 12, wherein the second outer circumference includes a press-fit corresponding portion combined with the press-fit portion, and wherein a thickness of the press-fit corresponding portion is five times to eight times greater than a thickness of the press-fit portion.

20. The linear compressor according to claim 11, wherein the frame and the cylinder are made of aluminum or an aluminum alloy.

21. The linear compressor according to claim 1, wherein the space is defined by the inner circumferential surface of the hook, the second outer circumference, and the protrusion.

* * * * *